United States Patent [19]

Sentoku et al.

[11] Patent Number: 4,897,984

[45] **Date of Patent: * Feb. 6, 1990**

[54] COIN RECEIVING AND WRAPPING APPARATUS

[75] Inventors: Hideshi Sentoku; Takayoshi Asaoka, both of Tokyo, Japan

[73] Assignee: Laurel Bank Machines Co. Ltd., Tokyo, Japan

[ * ] Notice: The portion of the term of this patent subsequent to Jan. 30, 2007 has been disclaimed.

[21] Appl. No.: 211,577

[22] Filed: Jun. 27, 1988

[30] Foreign Application Priority Data

Jun. 30, 1987 [JP] Japan ..... 62-163460
Jul. 14, 1987 [JP] Japan ..... 62-175617

[51] Int. Cl.[4] ..... B65B 11/04; B65B 57/20

[52] U.S. Cl. ..... 53/501; 53/212; 53/532

[58] Field of Search ..... 53/212, 501, 532; 453/12, 31, 54; 194/350

[56] References Cited

U.S. PATENT DOCUMENTS 1,168,461 1/1916 Batdorf ..... 453/31 X
3,350,835 11/1967 Becker ..... 53/212 X
3,948,376 4/1976 Roman ..... 194/350 X
4,102,110 7/1978 Iizuka ..... 53/212
4,123,892 11/1978 Asami ..... 53/212
4,666,027 5/1987 Ostroski ..... 194/350 X

FOREIGN PATENT DOCUMENTS 33792 3/1978 Japan ..... 53/212

*Primary Examiner*—John Sipos
*Attorney, Agent, or Firm*—Fleit, Jacobson, Cohn, Price, Holman & Stern

[57] ABSTRACT

The present invention relates to a coin handling apparatus for coin receiving and coin wrapping operations. A coin receiving apparatus of the present invention is provided with a safe means in which coins received in the apparatus are stored after the total value of the coins has been calculated. The apparatus is also provided with a transfer means for taking out the coins stored in the safe means. In another aspect of the present invention, a coin receiving and wrapping apparatus is provided having both coin receiving and wrapping operations functions.

4 Claims, 3 Drawing Sheets

COIN RECEIVING AND WRAPPING APPARATUS

BACKGROUND OF THE INVENTION

1. Field of the Invention

The present invention relates to a coin handling system utilized in banking facilities et al. and more specifically to a coin recieving and wrapping apparatus in which received coins are discriminated and are wrapped according to denomination.

2. Prior Art Description

A large amount of coins must be processed in banking facilities, taxi services and the like so as to detect false coins, calculate the value thereof, discriminate thereof according to denomination etc. For instance, in a bank, lots of coins collected from retailers and the like are counted and are wrapped according to denomination. For carrying out this kind of operation, banks usually posseses both a coin receiving machine and a coin wrapping machine. The coin receiving machine receives coins in a hopper and discriminates false coins from genuine ones and then counts the number of coins of each denomination. Having the denominations and the numbers of the coins, the machine further calculates the total value of the received coins. A machine of this kind is, for example, disclosed in Japanese Patent Public-Disclosure No. 55-92990.

The coin wrapping machine is provided with a discrimination mechanism by which coins put therein are discriminated and divided into groups according to denomination. The coins of the same denomination are stacked into a certain number and wrapped in transparent film material and the like in a wrapping portion in the machine. In the conventional discrimination mechanism, coins are sorted in order from larger diameter coins to smaller ones and accordingly the wrapping operation is carried out from the larger coins to the smaller ones. A typical coin wrapping machine is disclosed in Japanese Patent Public-Disclosure No. 59-84721.

Thus, an operator has firstly to put coins into a coin receiving machine in order to calculate the total value of the coins. After that he or she has to take out the calculated coins from the receiving machine and bring them into a separate coin wrapping machine in order to have the coins wrapped by denomination and in the same number.

As described above, the conventional coin handling process needs two separate machines, a coin receiving machine and a coin wrapping machine, which therefore requires space for installation of these two machines. An operator has to operate the separate machines individually, so operation of the machines tends to be more elaborate. Further, after processing of the coins in the receiving machine, they must be transferred to the separate wrapping machine, so an operator has to do the additional work of carrying the coins to the wrapping machine, and there arises a likelihood of coins being lost during the transfer. In addition, if the wrapping operation is not carried out immediately after the processing of the coins, the processed coins must be temporarily stored in a safe until the wrapping operation thereof is initiated.

In addition, the conventional discrimination mechanism is constructed to sort coins in order from larger diameter ones to smaller ones, and denomination of coins to be wrapped first cannot be arbitrarily selected.

SUMMARY OF THE INVENTION

Therefore, an object of the present invention is to provide an improved coin receiving apparatus which has a function to store the processed coins safely until they are subjected to a wrapping operation.

Another object of the present invention is to provide a coin receiving apparatus which is able to store processed coins safely until they are subjected to a wrapping operation and is able to take out the stored coins automatically.

Another object of the present invention is to provide a coin receiving and wrapping apparatus in which the functions of the coin receiving operation and the coin wrapping operation are integrated.

Still another object of the present invention is to provide a coin receiving and wrapping apparatus in which the functions of the coin receiving operation and the coin wrapping operation are integrated, wherein the wrapping order by domination is selectably determined by an operator.

In one aspect of the present invention, there is provided a coin receiving apparatus which comprises an upper hopper for receiving coins, a coin discrimination means which receives coins from said upper hopper, discriminates false coins and calculates the total value of the coins, a temporary storage means releasably installed in a housing of the apparatus and receiving said coins judged to be genuine from said discrimination means, and a safe means for receiving coins from said temporary storage means and storing them which is formed inside the housing of the apparatus and is not accessible from outside the housing. In a preferred embodiment, the apparatus is provided with a transfer means between said safe means and said upper hopper which transfers the coins stored in the storage to the upper hopper for a subsequent process such as a wrapping operation.

According to the present invention, coins discriminated by the discrimination means in the apparatus can be stored in the safe. Thus, carrying of the processed coins from the apparatus to a separate safe for a subsequent operation can be avoided. In addition, according to the preferred embodiment, the coins stored in the safe means can be automatically transferred to the upper hopper, which facilitates removal of the coins stored in the safe by an operator.

In another aspect of the present invention, a coin receiving and wrapping apparatus is provided which comprises an upper hopper for receiving coins; coin discrimination means which includes a receiving means for receiving coins from said upper hopper, false-coin detecting means for detecting false coins among the coins received by the receiving means and allowing only genuine ones to pass therethrough, denomination detecting means for detecting the denomination of the genuine coins, a calculation means for calculating the value of the genuine coins, and sorting means for sorting the genuine coins of designated denomination for wrapping from other coins; and a coin stacking means for receiving coins for wapping from the sorting means and piling them in stacks of a predetermined quantity; a coin wrapping means which receives stacks of coins from said stacking means and wraps them with a film material to form cylindrically wrapped stacks of coins; a wrapped-coin storage means for storing wrapped stacks of coins; a safe means for receiving coins from said coin discrimination means and storing them which is formed inside the housing of the apparatus and is not accessible from outside the housing; a transfer means for transferring coins stored in said safe to said upper hopper; and denomination setting means for setting the denomination of coins to be delivered to said coin stacking means for wrapping.

According to the present invention, coin reception and coin wrapping are both performed, and therefore space for installation of two apparatuses for handling coins is not required, or for carrying coins to a wrapping apparatus after calculation of the value of the coins by a receiving apparatus, or for operating these two apparatuses individually. Further, as coins do not have to carry from one apparatus to another, there is no risk of losing coins during such an operation.

In a preferred embodiment, the calculating means is provided with a function for calculating the number of coins of each denomination. A memory means is provided for storing the number of coins of each denomination calculated by said calculation means. A wrapping control means is also provided so that in accordance with the contents of the memory means the denomination of coins which are the most numerous are wrapped first, which reduces the total number of coins transferred through the apparatus for the following wrapping operation in comparison where the other denomination of coins is designated for wrapping. Hence, the total processing time for wrapping coins can be reduced.

Further, in another preferred embodiment, a temporary storage means is releasably installed in the housing of the apparatus between said sorting means and said safe means. This provides an operator with easy access to coins received in the apparatus.

Other objects and advantages of the present invention will become apparent upon reading the following detailed description with reference to the attached drawings.

DESCRIPTION OF THE PREFERRED EMBODIMENT

While the present invention will be described in connection with the preferred embodiment, it will be understood that we do not intend to limit the invention to this embodiment. On the contrary, we intend to cover all alternatives, modifications, and equivalents as may be included within the spirit and scope of the invention as defined by the attached claims.

Figure 1:
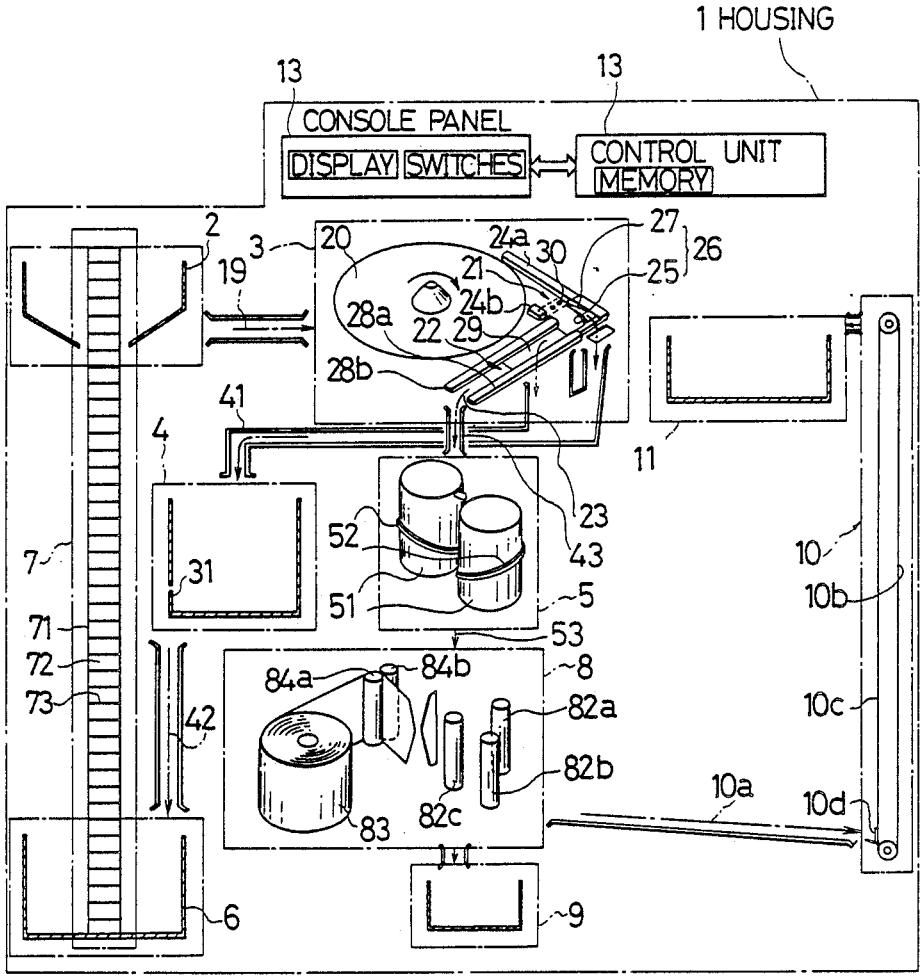
FIG. 1 is a schematic diagram of an apparatus in accordance with the present invention.

Referring now to the drawings, FIG. 1 illustrates an apparatus of the present invention which performs coin receiving and wrapping operations. In FIG. 1, an upper hopper 2 is located on the upper end of a housing 1 of the apparatus and opens upward for receiving coins. The upper hopper 2 communicates by a coin transfer means 19 to a coin discrimination portion 3. The discrimination portion 3 judges whether a coin is genuine or not, its denomination, counts how many coins of each denomination pass therethrough, and calculates the value of the coins that pass therethrough. Below the discrimination portion 3 are located a temporary storage portion 4 and a coin stacking portion 5, which are communicated by coin transfer means 41, 43, respectively. The temporary storage portion 4 is releasably attached inside the housing 1 and stores coins which pass through the discrimination portion 3. A lower hopper 6 is located beneath the temporary storage portion 4 and is communicated through a coin transfer means 42 therewith. The lower hopper 6 is constructed so as not to be accessible from outside the housing 1, and so it serves as a safe. A vertical coin transfer means 7 in the form of a vertical conveyor is disposed between the lower hopper 6 and the upper hopper 2 to transfer coins stored in the lower hopper 6 to the upper hopper 2.

A coin wrapping portion 8 is located below the coin stacking portion 5 which receives coins to be wrapped from the coin stacking portion 5 through a coin pass 53. In the wrapping portion 8, each set of stacked coins is wrapped by transparent film material or the like. Wrapped coins are then transferred to a wrapped coin storage 11 by a transfer means 10 having a coin slope 10*a* and a vertical coin conveyor 10*b*. Beneath the wrapping portion 8, a storage 9 is releasably attached inside the housing 1 and receives mal-wrapped coins from the wrapping portion 8.

On the top of the housing 1, there is provided a console panel 12, which has a switching means for controlling the operation of the apparatus and a display means for displaying the value of coins received in the apparatus and the number of coins of each denomination and for indicating when false coins are detected. A control unit 13 is also provided in order to control the above portions so as to perform a coin receiving and wrapping operations. The control unit 13 includes a memory means wherein a total value of coins, the number of coins of each denomination passing through the discrimination portion 3 and the like are stored.

Some of the above portions will now be explained in detail.

Coin discrimination portion 3:

The coin discrimination portion 3 includes a means for discriminating the denomination of coins which comprises a rotatable disc plate 20, a primary discrimination passages 21 and a secondary discrimination passage 22. The passage 21, 22 are disposed normal to each other and are arranged in a tangential direction of the disc plate 20. When coins are received in the upper hopper 2 and reach the rotating plate 20, they are moved in the tangential direction of the disc plate 20 with centrifugal force acting thereon and are passed along the primary passage 21. The primary passage 21 includes a pair of guide members 24*a*, 24*b* which are spaced from and parallel to each other. The gap between the guide members 24*a*, 24*b* is set such that all denominations of coins which will be handled by the apparatus can be passed between the guide members 24*a*, 24*b*. The outer guide member 24*a* is provided at its end with a reject member 26 having a lead wall 25 and a slope 27. The lead wall 25 is an arcuate in shape so as to guide coins passed through the passage 21 to enter the secondary passage 22. The reject member 26 is movable toward and away from the center of the arc of the wall 25. In the present embodiment, the member 26 is adjustable in response to the selection of denomination, so that coins whose diameter is equal to or smaller than that of a selected denomination are guided to the secondary passage 22; that is, those coins passed through the primary passage 21 move along the lead wall 25 and turn toward the secondary passage 22, while coins whose diameter exceeds that of the selected denomination are not guided by the lead wall 25 but ride on to the slope 27 to be ejected from the passage 21. The ejected coins enter into the temporary storage portion 4 via the transfer means 41.

The secondary passage 22 includes selection guide members 28*a*, 28*b* which are spaced from and parallel to each other. The gap between these members is adjustable according to a selected denomination. That is, the gap is set such that it is equal to the diameter of coins of the selected denomination, whereby coins having a diameter the same as or larger than that of the selected denomination are guided by the members 28*a*, 28*b* to an exit port 23, whereas coins of a smaller diameter drop between the members 28*a*, 28*b* into an ejection hole 29 to be ejected from the passage 22. The ejected coins enter the temporary storage 4 via the transfer means 43. Only coins of selected denomination reach the exit port 23 and are transferred by the transfer means 43 to the coin stacking portion 5. The coin discrimination mechanism of the above mentioned type is, for example, disclosed in Japanese Utility Model Public Disclosure No. 56-88380 and Japanese Patent Application No. 62-65348.

The discrimination portion 3 also serves to discriminate false coins and denominations of coins passing therethrough. For this purpose, a sensor 30 is disposed in the primary passage 21. The sensor is, for instance, of a magnetic type that, based on the fact that coins are made of specific materials and therefore have specific magnetic properties such as permeability, detects magnetic permeability of a coin passing thereby and generates a corresponding electrical signal which is provided to the control unit 13. In the control unit 13, the input signal is compared with denomination reference signals to thereby determine whether a coin passed by the sensor 30 is genuine or not, and its denomination. Further, based on the output signals of the sensor, the number of coins of each denomination is counted. From the counted number of coins of each denomination, the total value of coins passed through the passage 21 is attained. The total value of coins and the number of coins of each denomination are stored in the memory means in the control unit 13.

Temporary storage 4:

The temporary storage 4 stores coins ejected from the passage 21 and 22 and is releasably attached inside the housing 1. An exit gate 31 is provided at the lower portion of the storage 4, through which coins stored in the storage 4 can be transferred to the lower hopper 6 by means of the transfer means 41. The coins stored in the storage 4 can be transferred to the gate 31 such as by a transfer belt means disposed at the bottom of the storage 4 or by setting the bottom plate of the storage 4 to be tilted so that coins thereon can travel under their own weight toward the gate 31.

Transfer means 7:

The transfer means 7 consists of a vertical conveyor 71 between the upper and lower hoppers 2, 6. The conveyor 71 has a endless belt 72 which is provided with carrier plates 73 thereon arranged along the width of the belt 72. By the plates 73 coins stored in the lower hopper 6 are carried out therefrom and transferred into the upper hopper 2. In the upper hopper 2, a roller means or a plate means (not shown) is provided near the belt 72 in order to sweep coins out of the plates 73 and drop them in the upper hopper 2.

Coin stacking portion 5:

The coin stacking portion 5 is typically disclosed in Japanese Patent Public Disclosure No. 59-84721 and 62-208329. The coin stacking mechanism is such that a pair of rotating drums 51, 51 are provided on their outer surfaces with projections 52, 52 arranged spirally. With the rotation of the drums, coins inserted between the drums 51 are supported at their opposed pheripheral ends on the projections 52 and are moved along the projections, by which a predetermined number of coins are stacked in a cylindrical shape. A stacked of coins is then delivered to the coin wrapping portion 8.

Coin wrapping portion 8:

The coin wrapping portion 8 includes a coin wrapping mechanism which is typically disclosed in the above Japanese Patent Public Disclosure No. 59-84721, wherein three wrapping rolls 82*a*, 82*b*, and 82*c* are provided in order to grip the cylindrically stacked coins delivered from the stacking portion 5. A wrapping film roll 83 is also provided and is unrolled by a pair of transfer rolls 84*a*, 84*b* to transfer into the nip portion between a stack of coins and one of the wrapping rolls. By the rotation of the wrapping rolls 82*a* with a coin stack and the wrapping film, the coin stack is wrapped with the wrapping film to thereby produce a wrapped coin stack. If thereis a problem with the wrapping operation, the wrapping rolls are moved away from each other to thereby release the coins among them and drop them into the storage 9.

Transfer means 10:

The transfer means 10 disposed between the wrapping portion 8 and the wrapped coin storage 11 comprises a coin slope 10*a* and a vertical conveyor 10*b*. The coin slope 10*a* is, for example, a sloping plate disposed between the exit of the wrapping portion 8 and the lower end of the conveyor 10*b* to guide a wrapped coin stack to the conveyor 11*b*. The conveyor 10*b* is typically disclosed in Japanese Patent Public Disclosure No. 56-95822, and has an endless belt 10*c* carrying a basket 10*d*. By the basket 10*d*, wrapped coin stacks are carried up to the wrapped coin storage 11.

Figure 2:
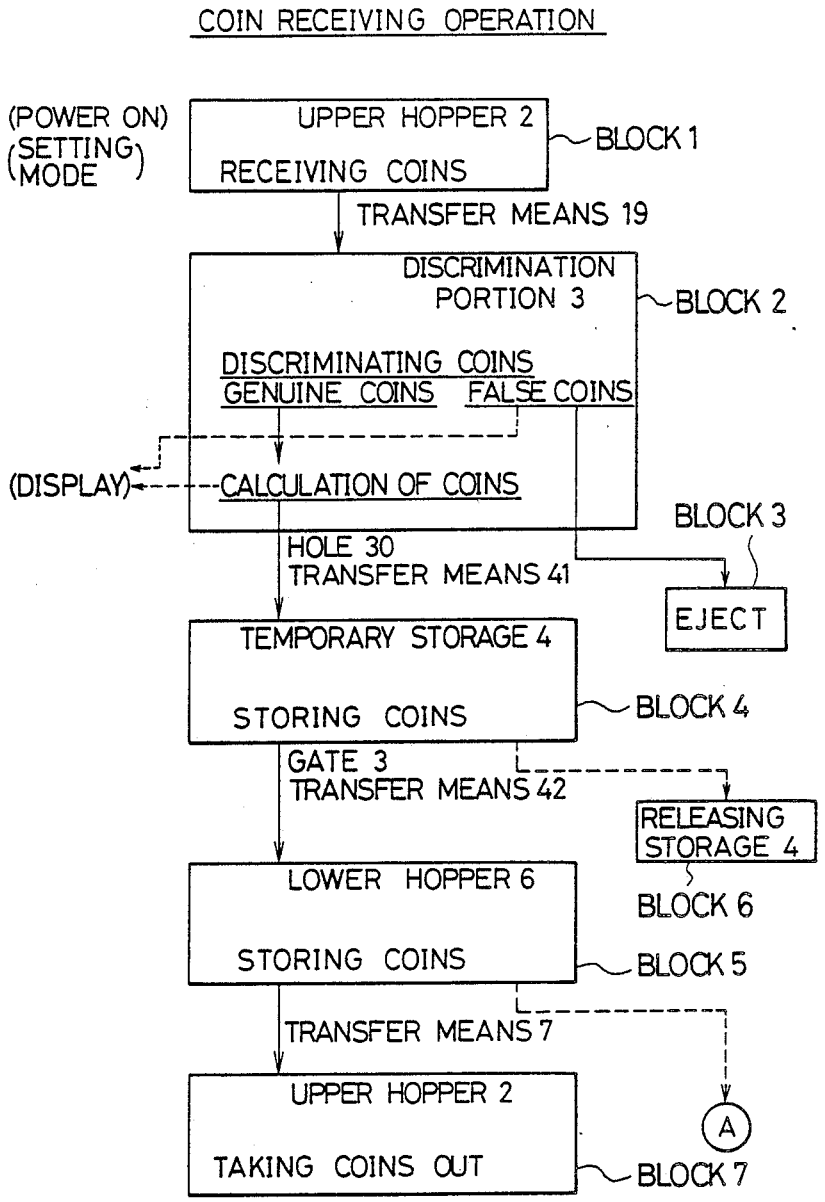
FIG. 2 is a flow chart showing a coin-receiving process performed by the apparatus of FIG. 1; and, FIG. 3 is a flow chart of a coin-wrapping process performed by the apparatus of FIG. 1.
Figure 3:
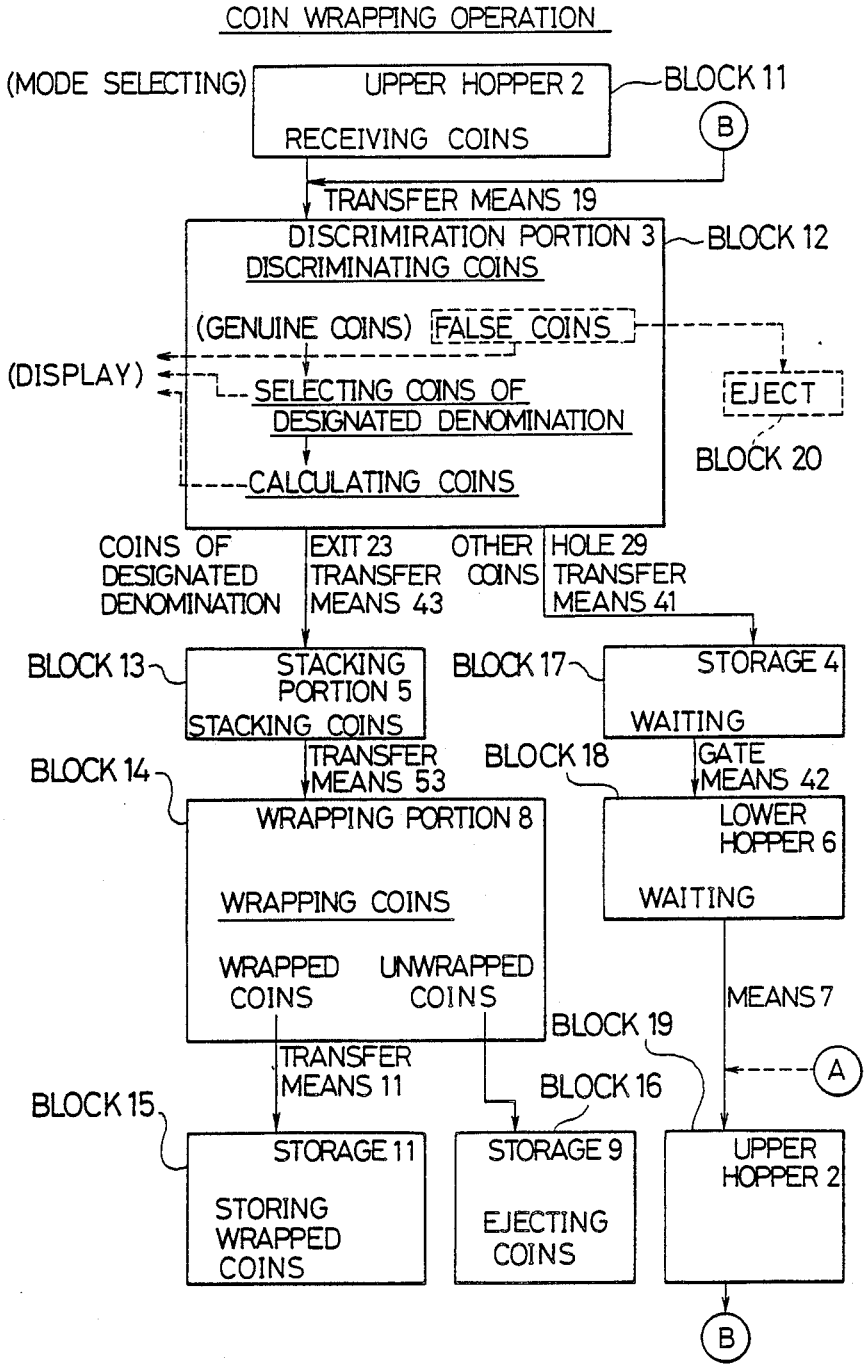

Referring now to FIGS. 2 and 3, the operation of the apparatus will be described. FIG. 2 illustrates the coin flow in the apparatus in the coin receiving operation.

Block 1:

A start switch on the console panel 12 is turned on and a coin receiving mode selection switch is turned on, by which the apparatus is initiated and set to the coin receiving mode. Then coins of different denominations such as 100 yen, 50 yen and 10 yen are put into the upper hopper 2 by an operator.

Block 2:

The received coins in the upper hopper 2 are carried by the transfer means 19 to the discrimination portion 3. In the coin receiving mode, the reject member 26 is positioned so that it allows passage of all of the coins into the secondary passage 22, and the gap between the guide 28*a*, 28*b* of the secondary passage 22 is set to be wider than the diameter of the coins. Hence, all of the coins rather than just false ones pass through the passage 21 and enter the passage 22 and are then dropped into the ejection hole 29. Further in the discrimination portion 3, the sensor 30 detects coins passing thereby and generates output signals, according to which the control unit 13 determines whether a coin passed by the sensor 30 is genuine or not and its denomination. Also, the unit 13 calculates numbers of coins of each denomination and the total value of the coins passed through the sensor 30. The calculated values are displayed on the display means of the console panel 12 and are stored in the memory means for the following operation.

Block 3:

The false coins separated from the genuine ones are ejected from the passage 21 and carried out into a reject box (not shown).

Block 4:

The genuine coins, which dropped into the hole 29, are carried by the transfer means 41 to the temporary storage 4.

Blocks 5, 6:

After the calculated values are displayed, a switch for controlling the gate 31 is turned on, the gate is opened through which the coins stored in the temporary storage 4 are carried to the lower hopper 6 by means of transfer means 42. If the operator wishes to check the coins stored in the temporary storage 4, he may release the temporary storage 4 from the housing 1 (Block 6) to check the coins directly prior to the turning on the switch for controlling the gate 31.

The above mentioned operation is repeated to store coins received in the upper hopper 2 in the lower storage in the form of a safe. Simultaneously, the total value of stored coins and the number of coins of each denomination are calculated and stored in the memory means in the control unit 13.

Block 7:

If the coins stored in the lower hopper 6 are to be taken out, a switch for driving the transfer means 7 may be turned on to carry the coins out to the upper hopper 2.

After the coin receiving operation is completed, if a switch for setting the coin wrapping mode is turned on by an operator, the apparatus will go into the coin wrapping mode as shown in FIG. 3. In addition, The apparatus of the present embodiment also has an automatic mode wherein the coin receiving and wrapping operations are carried out continuously, i.e., a coin wrapping operation follows each coin receiving operation.

Block 11:

Coins are put in the upper hopper 2 by an operator, or in the automatic mode the coins stored in the lower hopper 6 are carried out in the upper hopper 2 by means of the transfer means 7.

Block 12:

The coins received in the hopper 2 are then carried to the coin discrimination portion 3. In the coin wrapping mode or the automatic mode of the present embodiment, the denomination of coins to be wrapped is automatically designated to be that of the large number of coins. The designation is carried out under the control of the control unit 13 which stores the number of coins of each denomination in the memory means, decides the denomination of the largest number of coins based on the stored values and designates that denomination to be wrapped. In the discrimination portion 3, the reject member 26 is positioned so as to guide coins whose diameter is equal to or smaller than that of the designated denomination to be wrapped, whereas the gap between the members 28*a*, 28*b* in the secondary passage 22 is set to guide by the members 28*a*, 28*b* only coins whose diameter is equal to or larger than that of the designated denomination. Thus, coins whose diameter is equal to that of the designated denomination can only be passed through the passages 21 and 22 to reach the exit port 23, through which they enter the transfer means 43, while coins other than coins of the designated denomination are ejected from the passage 21 or 22 and enter the transfer means 41.

The calculation of the number of coins of each denomination and the total value of the coins passed by the sensor 30 are conducted simultaneously. Also, false coins are separated from the genuine ones and ejected from the passage 21.

Block 13:

The coins of the designated denomination are carried by the transfer means 43 to the coin stacking portion 5. In the stacking portion 5, a predetermined number of coins are stacked in a cylindrical form. The obtained coin stack is transferred to the wrapping portion 8.

The calculation of the number of coins which are stacked can be conducted by either of the following methods: One is that the number of coins of designated denomination is counted by the sensor 30 and when the counted number reaches the predetermined value the stacked coins in the stacking portion 5 are carried out to the wrapping portion 8. This method is adopted for coins subjected to the coin receiving operation because false coins have been already discriminated. The other is that another sensor is disposed at the end of the secondary passage 22 to directly count the number of coins supplied to the stacking portion 5 and when the counted number reaches the predetermined value the stacked coins in the stacking portion are carried to the wrapping portion 8.

Blocks 14–16:

The stacked coins in the wrapping portion are held among the rollers 82*a*, 82*b*, and 82*c* and the wrapping the paper around the stacked coins are conducted. Thus, a wrapped stacked coin is obtained. The wrapped coin stack is then transferred by the means 10 to the wrapped coin storage 11 and stored therein (as shown by Blocks 14 and 15).

If coin supply from the discrimination portion 3 to the stacking portion 5 ceases before the number of the stacked coins reaches the predetermined value, the unstacked coins are transferred to and passed through the wrapping portion 8 to be stored in the storage 9 (Block 16).

Blocks 17–19:

Coins other than those of the designated denomination are carried by the transfer means 41 to the temporary storage 4 and stored therein until all the coins are passed through the discrimination portion 3 which can be detected by the sensor 30 detecting no coins passing for a given period of time. After all the coins have passed through the discrimination portion 3, the gate 31 is opened by the control unit 13 to transfer the temporarily stored coins in the storage 4 to the lower hopper 6 via the means 42 (Block 18). Alternatively, the gate 31 may be set to be open so that the coins from the discrimination portion 3 can be passed through the temporary storage and be stored in the lower hopper 6. The transfer means 7 is driven to carry the coins stored in the lower hopper 6 up to the upper hopper 2 (Block 19). This completes one coin wrapping operation.

After that, the same sequence of wrapping operations will be carried out until the all denominations of coins are wrapped.

In the above embodiment, the denomination of coins to be wrapped is designated to be that of the largest number. Alternatively, the designation of denomination may be carried out in order from that of larger diameter to smaller diameter or vice versa. It is apparent that the reject member may be eliminated if the wrapping order is from coins of larger diameter, whereas the secondary passage 22 may be eliminated if the wrapping order is from coins of smaller diameter. Or, the designation of denomination may be set manually.

In addition, if an operator wishes to conduct only the wrapping operation, coins put in the upper hopper 2 are carried into the discrimination portion 3 wherein false coins are discriminated and ejected from the apparatus (as shown by Block 20 in FIG. 3).

We claim:

1. A coin receiving and wrapping apparatus comprising:

a housing including upper hopper means for receiving coins, discriminating means for discriminating denominations and genuineness of coins received via said upper hopper means and counting the value of genuine received coins, sorting means for sorting coins having a designated denomination for wrapping, coin stacking means for receiving coins for wrapping from said sorting means and stacking the coins to make stacks of a predetermined number of coins, coin wrapping means for receiving said stacks of coins from said coin stacking means and wrapping said stacks with a film material to make cylindrically-wrapped stacks of coins, wrapped-coin storage means for storing wrapped stacks of coins, temporary storage means detachably mounted on said housing for temporarily holding the coins sorted by said sorting means and determined to be coins other than those to be wrapped, safe means for receiving coins from said temporary storage means and storing them therein, said safe means being disposed in said housing and being inaccessible from outside of said housing, transfer means for transferring coins stored in said safe means to said upper hopper means, and denomination setting means for setting said sorting means so as to designate a denomination of coins to be delivered to said coin stacking means for wrapping.

2. A coin receiving and wrapping apparatus as defined in claim 1, further comprising first and second passage means for transporting received coins, said second passage means being disposed downstream of said first passage means, said discriminating means being disposed in the first passage means, and said sorting means includes first coin excluding means provided in the vicinity of one end of said first passage means for excluding coins having a larger diameter than that of the designated denomination of coins and feeding the coins of the other denominations to said second passage means, and second coin excluding means provided in said second passage means for excluding coins having a smaller diameter than that of the designated denomination of coins.

3. A coin receiving and wrapping apparatus as defined in claim 1, wherein said discriminating means count the value of the received coins by calculating the number of each denomination of coins and said denomination setting means set the designated denomination of coins so that the denomination of coins of largest number is set for wrapping.

4. A coin receiving and wrapping apparatus as defined in claim 2, wherein said first coin excluding means comprises wall means engageable with a side face of the designated denomination of coins to deflect the moving direction of the received coins having a diameter equal to or smaller than that of the designated denomination of coins and inclined surface means onto which the received coins having a larger diameter than that of the designated denomination of coins climb up and move straight, and said denomination setting means set a denomination of coins to be fed to the coin stacking means to control the position of said wall means.

* * * * *